United States Patent [19]

Hasebe

[11] Patent Number: 4,940,971

[45] Date of Patent: Jul. 10, 1990

[54] BIT MAP DISPLAY APPARATUS FOR PERFORMING AN INTERRUPTION DISPLAY AMONG PLANES AT HIGH SPEED

[75] Inventor: Kouki Hasebe, Fuchu, Japan

[73] Assignee: Kabushiki Kaisha Toshiba, Kawasaki, Japan

[21] Appl. No.: 238,222

[22] Filed: Aug. 30, 1988

[30] Foreign Application Priority Data

Aug. 31, 1987 [JP] Japan ..... 62-216658

[51] Int. Cl.[5] ..... G09G 5/14

[52] U.S. Cl. ..... 340/721; 340/734

[58] Field of Search ..... 340/721, 734, 724, 798, 340/799, 747, 701, 703; 364/518, 521

[56] References Cited

U.S. PATENT DOCUMENTS

| | | | |
|---|---|---|---|
| 4,509,043 | 4/1985 | Mossaides | 340/747 |
| 4,742,474 | 5/1988 | Knierim | 340/799 |
| 4,766,431 | 8/1988 | Kobayashi et al. | 340/723 |
| 4,823,119 | 4/1989 | Ishii | 340/701 |
| 4,857,905 | 8/1989 | Ogawa | 340/703 |

OTHER PUBLICATIONS

Kouki Hasebe, AM95C60 (QP-DM) Technical Manual, AM95C60 and AM8171, pp. 115-116.

*Primary Examiner*—Jeffery A. Brier

*Attorney, Agent, or Firm*—Finnegan, Henderson, Farabow, Garrett, and Dunner

[57] ABSTRACT

A bit map display apparatus of this invention includes a bit map memory consisting of a plurality of memory planes, a display controller which can output a window number indicating a displaying window in accordance with display scan, a register, arranged for each plane, for holding bit data for designating a display enable/disable state in units of windows, a selector, arranged for each plane, for selecting one bit of output data from the corresponding register as a mask bit in accordance with the window number indicated by the display controller, and a gate circuit, arranged for each plane, for controlling data read out from the corresponding plane in accordance with the mask bit.

11 Claims, 6 Drawing Sheets

| A5 | A4 | A3 | A2 | A1 | A0 | M2 | M1 | M0 |
|---|---|---|---|---|---|---|---|---|
| X | X | X | X | 0 | 1 | 1 | 0 | 0 |
| X | X | 1 | 0 | OTHER THAN "01" | | 0 | 1 | 0 |
| X | X | OTHER THAN "10" | | OTHER THAN "01" | | 0 | 0 | 1 |

BIT MAP DISPLAY APPARATUS FOR PERFORMING AN INTERRUPTION DISPLAY AMONG PLANES AT HIGH SPEED

BACKGROUND OF THE INVENTION

1. Field of the Invention

The present invention relates to a bit map display apparatus having a hardware-window function.

2. Description of the Related Art

In a recent bit map display apparatus, a display function, called a multiwindow display function, for displaying a plurality of data on a single screen, is required. As one means for realizing the multiwindow display, a hardware-window system by display address control is known. The multiwindow display by the conventional hardware-window system is realized as follows. That is, as shown in FIG. 1, window area 3 is set on an area, which is not normally displayed, of frame memory space 2 larger than display screen 1, and is interrupted on the screen by switching display addresses.

However, in the above system, (1) High-speed switching of display addresses is necessary.

(2) When a frame memory includes a plurality of planes, the window area is not interrupted on the screen for each plane. Therefore, since the same window area is set for all the planes, this system cannot be utilized for a frame memory having different images in units of planes.

SUMMARY OF THE INVENTION

It is an object of the present invention to provide a bit map display apparatus which can easily perform an interruption display among planes at high speed even if a hardware window is set for each plane of a frame memory.

In order to achieve the above object, a bit map display apparatus according to the present invention has a bit map memory having a plurality of memory planes storing image data. A display controller sets at least one hardware window, and outputs a window number indicating a displaying window in accordance with display scan. A window control data registors are arranged for each of the memory planes, and store data for designating a display enable/disable state for each hardware window. Multiplexers are arranged for each of the memory planes, and selects window display control data output from a corresponding one of the window control data registers as mask data in accordance with the window number indicated by the display controller. AND gates are arranged for each of the memory planes in accordance with the mask data selected by a corresponding one of the multiplexers.

With the above arrangement, the mask data is prepared in correspondence with a window set for each plane, so that an interruption display among planes can be achieved without switching display addresses.

DETAILED DESCRIPTION OF THE PREFERRED EMBODIMENTS

An embodiment of the present invention will be described hereinafter with reference to the accompanying drawings.

Figure 1:
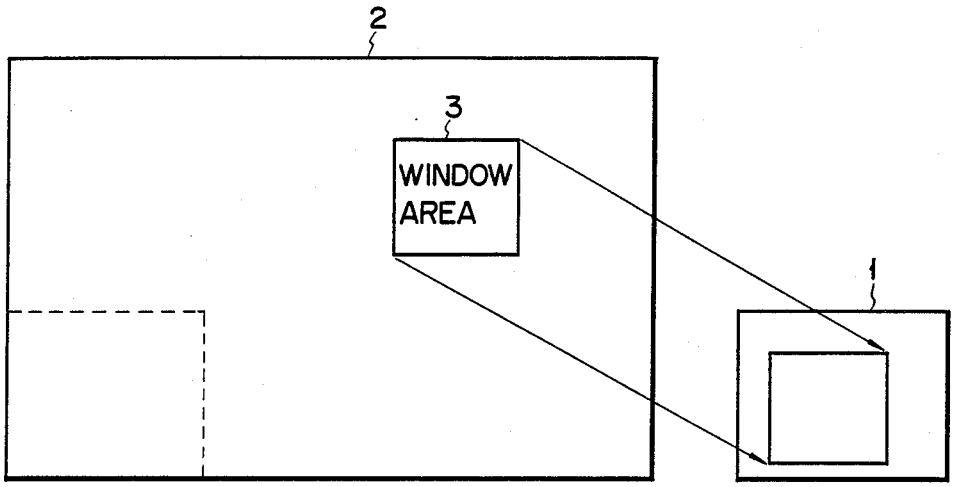
FIG. 1 (PRIOR ART)
FIG. 1 is a view for explaining a conventional hardware window.
Figure 3:
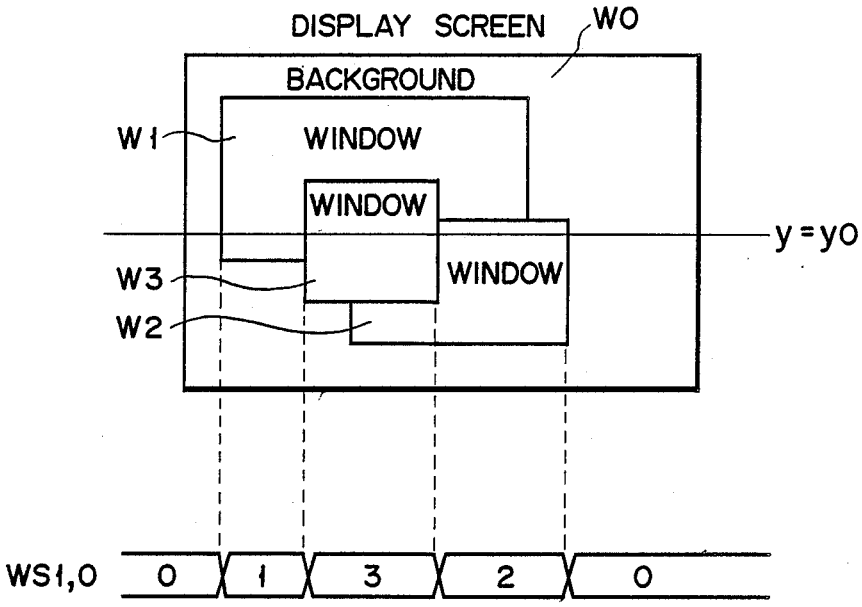
FIG. 3 is a view for explaining a window output function of a display controller shown in FIG. 2.
Figure 2:
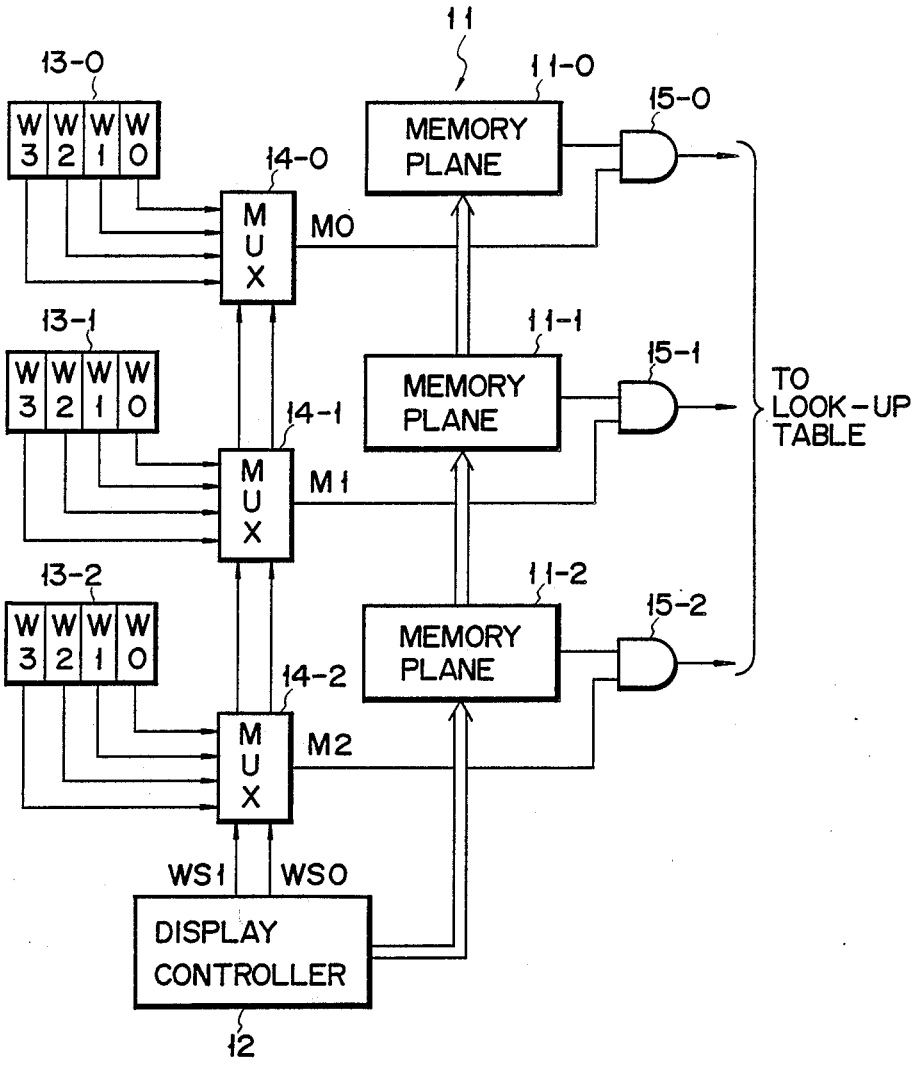
FIG. 2 is a block diagram showing an embodiment of a bit map display apparatus according to the present invention.

FIG. 2 is a block diagram partially showing a bit map display apparatus directly related to the present invention. In FIG. 2, reference numeral 11 denotes a bit map memory having three memory planes 11-0 through 11-2 for storing an image; and 12, a display controller for generating display addresses to bit map memory 11, generating a sync signal to a CRT monitor (not shown), and so on. Display controller 12 can employ, e.g., i82786 (available from Intel Corp., U.S.A.) which can display at least one hardware window (in FIG. 2, three, i.e., W1 through W3, and W0 is a background), and can output a window number of a displaying window in accordance with display scan, as shown in FIG. 3. Display controller 12 can set hardware windows W1 to W3, and outputs 2-bit window number data comprising of bits WS1 (MSB) and WS0 (LSB) for designating a displaying window number. Display controller 12 has a memory address switching function of hardware windows, but this function is not always necessary.

Reference numerals 13-0 through 13-2 denote window display control registers, arranged in correspondence with planes 11-0 through 11-2, for designating a window display enable/disable state for the corresponding plane. Each of registers 13-0 through 13-2 has a 4-bit configuration, i.e., bits w0 through w3. Bits w0 through w3 of registers 13-0 through 13-2 are used for setting a display enable/disable state for each of windows W0 through W3 (window W0 is a background). Reference numerals 14-0 through 14-2 denote multiplexers (MUXs) each of which selects one bit of a 4-bit output from each of registers 13-0 through 13-2 as one of mask bits M0 through M2 in accordance with window number data (WS1, WS0) from display controller 12; and 15-0 through 15-2, gate circuits, e.g., AND gates, for controlling outputting of display data (serial or parallel data) read out from planes 11-0 through 11-2 in accordance with a display address designated by display controller 12, in accordance with mask bits M0 through M2 from MUXs 14-0 through 14-2. The outputs from AND gates 15-0 through 15-2 are supplied to a look-up table (not shown) which receives and converts these outputs into color data and luminance data.

The operation of the arrangement shown in FIG. 2 will be described with reference to an example shown in FIG. 4. In the example shown in FIG. 4, three window W0, W1, and W2 are set (W0 is a background). Assume now that FIGS. 21, 22, and 23 are written in the areas 20 corresponding to a display screen of the respective planes 11-0 through 11-2 of bit map memory 11.

In this embodiment, since display controller 12 is shared by memory planes 11-0, 11-1 and 11-2, the image data are written in respective memory planes 11-0, 11-1, and 11-2 at common address position, when windows W0, W1, and W2 are superposed.

Setting of display controller 12 (setting of area 20 corresponding to a display screen, and setting of windows W1 and W2 on a display screen) is performed so that windows W1 are W2 are displayed on the display screen. This setting is performed by a microprocessor which is not shown.

In this case, the priority order of W1, W2, and W0 is determined to satisfy the relation W1>W2>W0. This screen display images (FIG. 4) of entire areas 20 of respective planes 11-0 through 11-2 corresponding to the display screen are read out from planes 11-0 through 11-2 in accordance with a display address (frame memory address) designated by display controller 12.

In this embodiment, FIGS. 21, 22, and 23 are displayed on windows W1, W2, W0 (background), respectively. For this purpose, the microprocessor sets "0", "1", "0" and "0" in bits w0, w1, w2, and w3 of register 13-0 corresponding to plane 11-0, sets "0", "0", "1", and "0" in bits w0, w1, w2, and w3 of register 13-1 corresponding to plane 11-1, and sets "1", "0", "0", and "0" in bits w0, w1, w2, and w3 of register 13-2 corresponding to plane 11-2.

Bits w0 through w3 of registers 13-0 through 13-2 are supplied to MUXs 14-0 through 14-2. If window number designation data comprising bits WS1 and WS0 output from display controller 12 in correspondence with a display address indicates "0" (WS1, WS0=0, 0), MUXs 14-0 through 14-2 select display enable/disable bit w0 of window W0 (background W0); and if "1" (WS1, WS0=0, 1), select display enable/disable bit w1 of window W1. Similarly, if window number designation data indicates "2" (WS1, WS0=1, 0), MUXs 14-0 through 14-2 select display enable/disable bit w2 of window W2; and if "3" (WS1, WS0=1, 1), select display enable/disable bit w3 of window W3. The selection output bits from MUXs 14-0 through 14-2 are used as mask bits M0 through M2 for mask images with respect to images read out from planes 11-0 through 11-2.

Figures 4, 8:
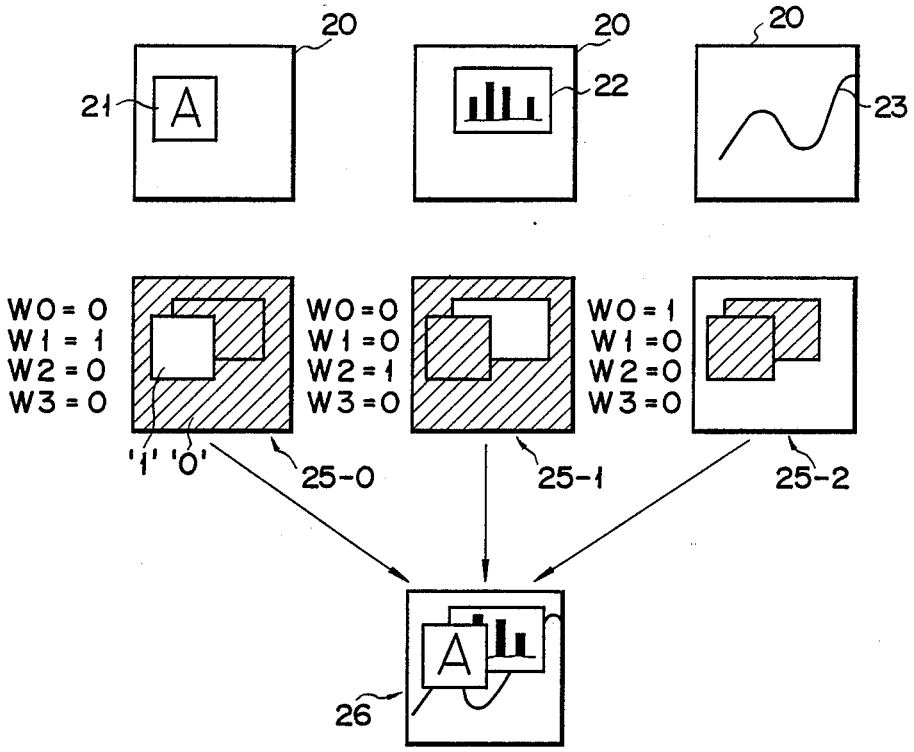
FIG. 4 is a view for explaining a plane interruption display operation of the bit map display apparatus shown in FIG. 2.
FIG. 8 is a view showing the content of a 2-port memory shown in FIG. 6.

A mask image for an image read out from plane 11-0 is as indicated by reference numeral 25-0 in FIG. 4 in this embodiment wherein of w0 through w3 of register 13-0, only w1 corresponding to window W1 is "1". Similarly, mask images for images read out from planes 11-1 and 11-2 are as indicated by reference numerals 25-1 and 25-2 in FIG. 4, respectively, in this embodiment wherein of w0 through w3 of registers 13-1 and 13-2, w2 corresponding to window W2 and w0 corresponding to window (background) W0 are "1".

Mask bits M0 through M2 from MUXs 14-0 through 14-2 are supplied to one input of each of AND gates 15-0 through 15-2. The other input of each of AND gates 15-0 through 15-2 receive images read out from planes 11-0 through 11-2. AND gates 15-0 through 15-2 output the images read out from planes 11-0 through 11-2 to the look-up table when mask bits M0 through M2 are "1". When the mask bits are "0", the AND gates disable outputting to the look-up table. As a result, for plane 11-0, only the image corresponding to window W1 is output from AND gate 15-0, and the remaining portion is masked to be "0". Similarly, for planes 11-1 and 11-2, only the images corresponding to windows W2 and W0 (background W0) are output from AND gates 15-1 and 15-2, and the remaining portions are masked to be "0". Therefore, when the content of the look-up table is set to yield the OR result of planes 11-0 through 11-2, a screen display indicated by reference numeral 26 in FIG. 4, i.e., an interruption display among planes can be performed.

In the first embodiment, although image data must be written at the same position as a display position, window interruption can be achieved without switching addresses by interrupting images in units of planes.

Figure 5:
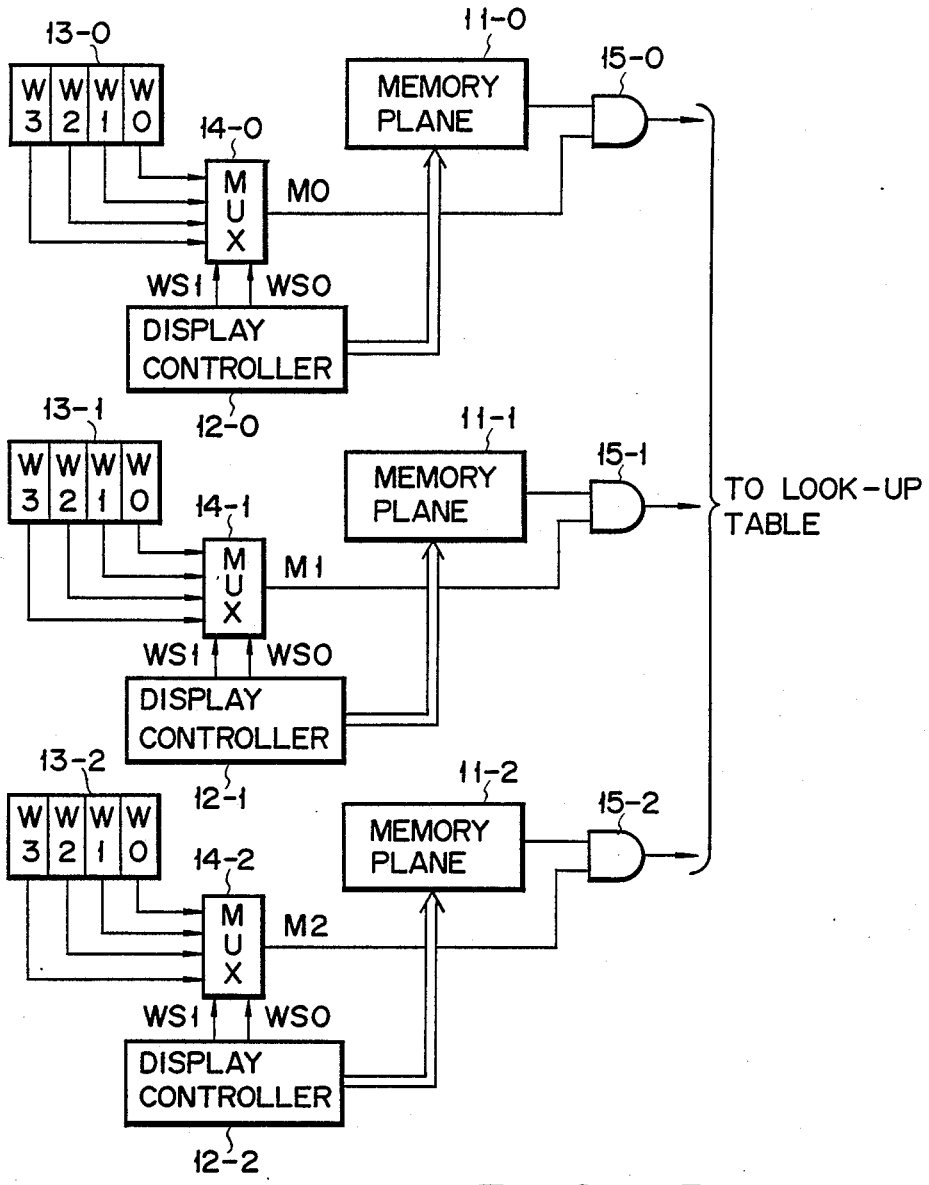
FIG. 5 is a block diagram showing another embodiment of a bit map display apparatus according to the present invention.

In the above embodiment, one display controller 12 is arranged common to planes 11-0 through 11-2. For this reason, possible window areas are common to planes 11-0 through 11-2. Instead of display controller 12 shown in FIG. 2, if display controllers 12-0 through 12-2 having the same function as display controller 12 are arranged in correspondence with planes 11-0 through 11-2, as shown in FIG. 5, hardware windows can be independently set in units of planes. When interruption among planes is performed with the arrangement shown in FIG. 5, a common area of planes 11-0 through 11-2 is assigned to one (e.g., window W1) of hardware windows W1 through W3 which can be independently set by display controllers 12-0 through 12-2, and window W1 is utilized for plane interruption. Other windows can be separate areas for each of planes 11-0 through 11-2. In this case, for bits w1 of registers 13-0 through 13-2 corresponding to interruption window W1, bit setting is performed in the same manner as in the arrangement shown in FIG. 2, and for bits of registers 13-0 through 13-2 corresponding to other windows, "1" is set to designate a display enable state.

Figure 7:
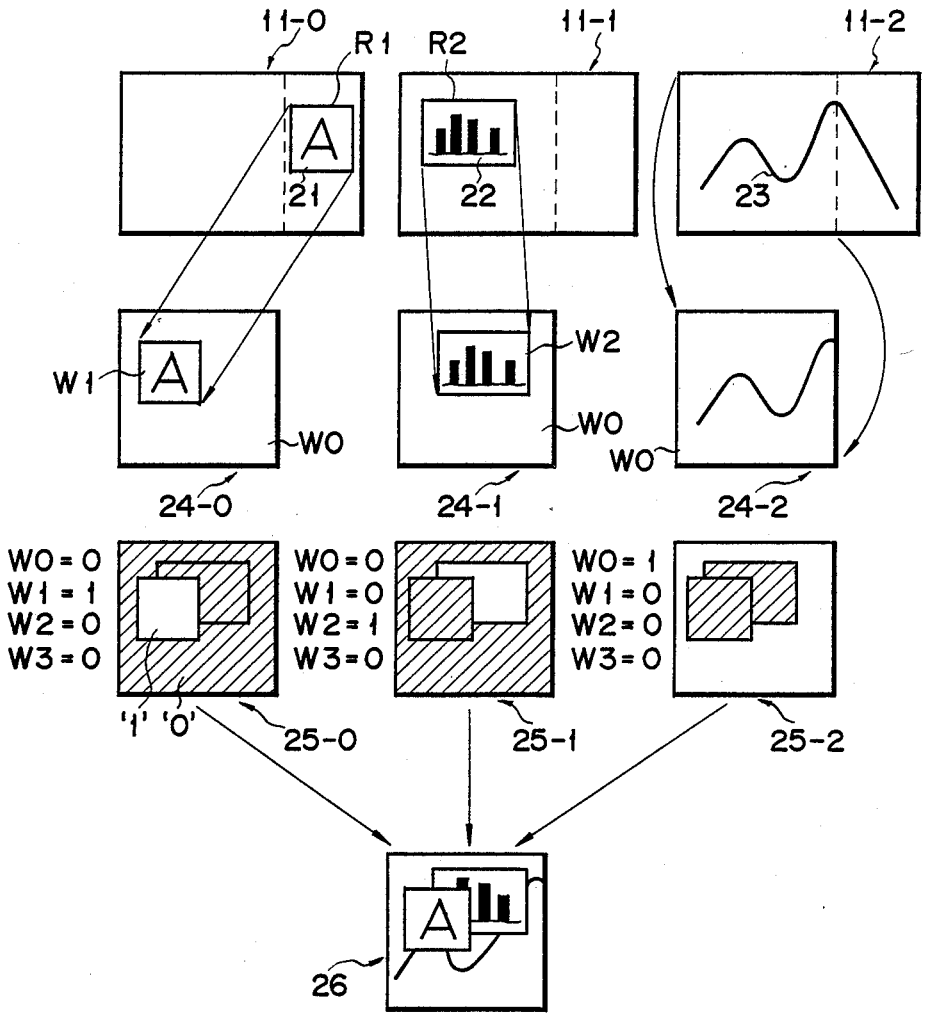
FIG. 7 is a view for explaining a plane interruption display operation of the bit map display apparatuses shown in FIGS. 5 and 6.

In this manner, unlike in the embodiment shown in FIG. 2, a figure need not be drawn on a memory plane area corresponding to a display screen, as shown in FIG. 7. More specifically, on memory plane 11-0, figure data 21 is written in a portion (area R1) of an area which is not normally displayed, FIG. 22 is written in a portion (area R2) of an area of memory plane 11-1 corresponding to the display screen, and FIG. 23 is written in the entire area of memory plane 11-2. Read areas R1 and R2 on bit map memory 11 are set for display controller 12, and windows W1 and W2 are set on the display screen. As a result, normally output screen display images indicated by reference numerals 24-0 through 24-2 in FIG. 7 are read out.

An embodiment simplifying the arrangement of FIG. 5 will be described with reference to FIG. 6. In the arrangement shown in FIG. 6, a memory common to all the planes 11-0 through 11-2, e.g., 3 (bit)×64 (word) 2-port memory 31, is arranged in place of registers 13-0 through 13-2 and MUXs 14-0 through 14-2 arranged for each of planes 11-0 through 11-2. Mask data consisting of mask bits M2 through M0 for masking images read out from planes 11-0 through 11-2 is prestored in 2-port memory 31 by the microprocessor. The mask data is read out from memory 31 when memory 31 is addressed by linked data of window number data from display controllers 12-2 through 12-0. An address of 2-port memory 31 has a 6-bit configuration, i.e., A5 through A0. Bits A5 and A4 are designated by bits WS1 and WS0 of window number data from display controller 12-2, bits A3 and A2 are designated by bits WS1 and WS0 of window number data from display controller 12-1, and bits A1 and A0 are designated by bits WS1 and WS0 of window number data from display controller 12-0.

Mask bits M2 through M0 read out from 2-port memory 31 are supplied to one input of each of AND gates 15-2 through 15-0 in the same manner as mask bits M2 through M0 from MUXs 14-2 through 14-0 in FIGS. 2 and 5, and are used for mask processing (output enable/disable control) for images read out from planes 11-2 through 11-0.

Figure 6:
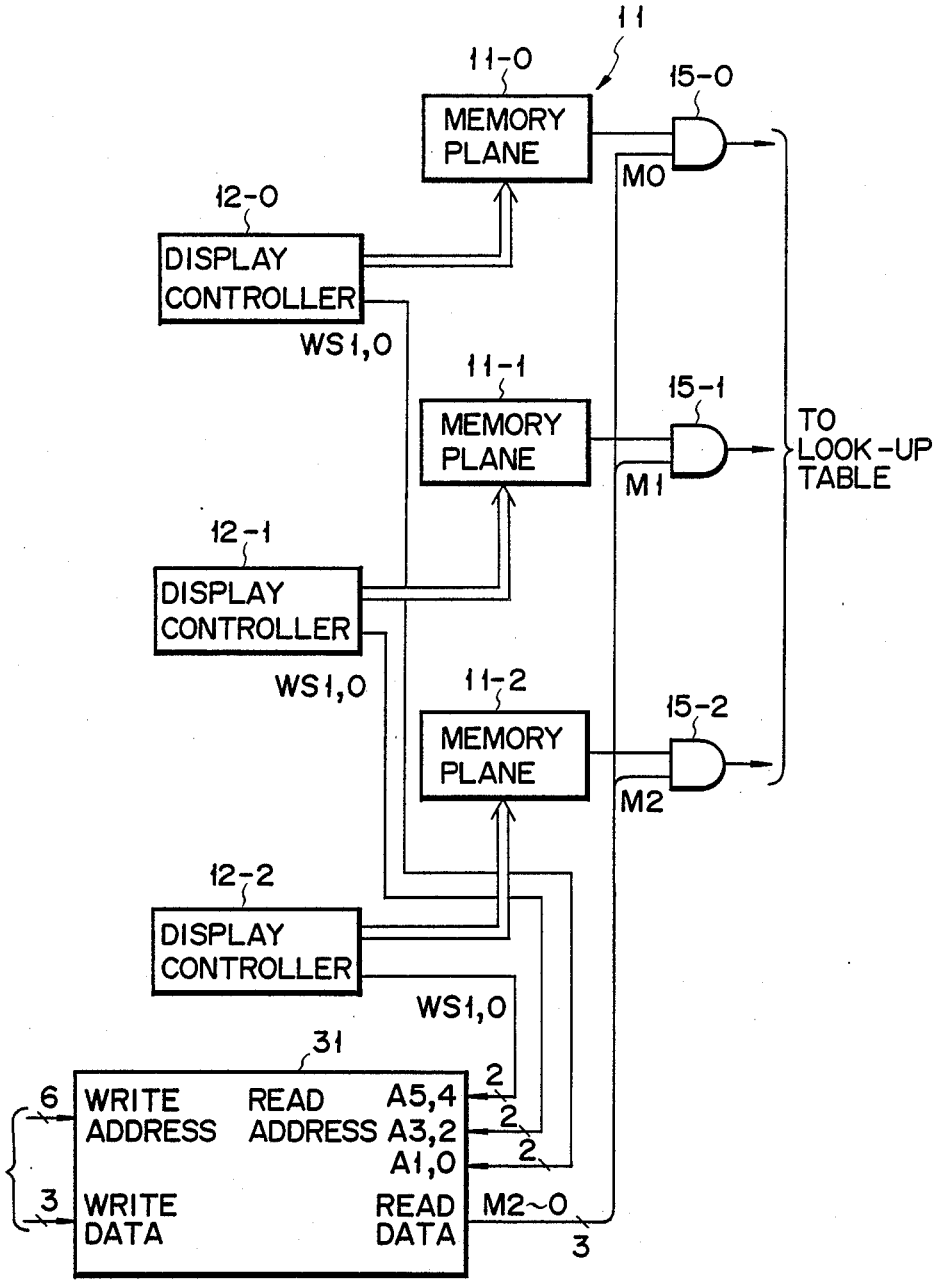
FIG. 6 is a view for explaining still another embodiment of a bit map display apparatus according to the present invention.

In the arrangement shown in FIG. 6, when mask data set at each address position of 2-port memory 31 is modified, an interruption area common to planes 11-0 through 11-2 need not be set unlike in the arrangement in FIG. 5. More specifically, in the arrangement shown in FIG. 6, even if all the window areas of planes 11-0 through 11-2 are different from each other, plane interruption can be achieved. For example, mask data set in 2-port memory 31 is modified as shown in FIG. 8, so that outputting of plane 11-1 can be inhibited on window W1 of plane 11-0, and outputting of plane 11-2 can be inhibited on windows W1 and W2 of planes 11-0 and 11-1. That is, in the arrangement shown in FIG. 6, a maximum of three hardware windows W1 through W3 of display controllers 12-0 through 12-2 can be independently set for each of planes 11-0 through 11-2, and can be arbitrarily interrupted on other planes. More specifically, in the embodiment shown in FIG. 5, if three windows are provided, in order to enable one window and to disable the remaining two windows, two window addresses must be generated. However, in the embodiment shown in FIG. 6, since one display controller can mask the remaining two windows using a self window signal, a total of nine windows can be displayed.

What is claimed is:

1. A bit map display apparatus comprising:
a bit map memory having a plurality of memory planes storing image data;
display control means for setting at least one hardware window, and for outputting a window number indicating a display window in accordance with a display scan;
window control data memory means, corresponding to each of the memory planes, for storing data for designating a display enable/disable state for each hardware window;
selection means, corresponding to each of the memory planes, for selecting window display control data output from a corresponding one of the window control data memory means as mask data in accordance with the window number; and
control means, coupled to each of the memory planes, for controlling outputting of data read out from a corresponding one of the memory planes in accordance with the mask data selected by said corresponding selection means.

2. An apparatus according to claim 1, wherein said display control means controls the plurality of memory planes.

3. An apparatus according to claim 1, wherein each of the window control data memory means stores data including a number of bits corresponding to the number of hardware windows.

4. An apparatus according to claim 3, wherein the selection means supplies the control means with one bit of output data of the window control data memory means corresponding to the window number as a mask bit.

5. An apparatus according to claim 4, wherein each of the control means has two input terminals, a first input terminal receiving data read out from the corresponding one of the memory planes, and a second input terminal receiving the mask bit from the corresponding one of the selection means.

6. A bit map display apparatus comprising:
a bit map memory having a plurality of memory planes storing image data;
a plurality of display control means, respectively coupled to each of said corresponding memory planes, for setting at least one hardware window, and for outputting a window number indicating a display window in accordance with a display scan;
window control data memory means, corresponding to each of the memory planes, for storing data for designating a display enable/disable state for each hardware window;
selection means, corresponding to each of the memory planes, for selecting window control data output from a corresponding one of the window control data memory means as mask data in accordance with the window number; and
control means, coupled to each of the memory planes, for controlling outputting of data read out from a corresponding one of the memory planes in accordance with the mask data selected by said corresponding selection means.

7. An apparatus according to claim 6, wherein each of the window control data memory means stores data including a number of bits corresponding to the number of the hardware windows.

8. An apparatus according to claim 7, wherein the selection means supplies control means with one bit of output data from the corresponding one of the window control data memory means corresponding to the window number as a mask bit.

9. An apparatus according to claim 8, wherein each of the control means has two input terminals, a first input terminal of said gate receiving data read out from the corresponding one of the memory planes, and a second input terminal receiving the mask bit from the corresponding one of the selection means.

10. A bit map display apparatus comprising:
a bit map memory having a plurality of memory planes storing image data;
display control means, corresponding to each of the memory planes, for setting at least one hardware window, and for outputting a window number indicating a display window in accordance with a display scan;
memory means for storing mask data having mask bits for designating a display enable/disable state for each of the memory planes, and being addressed by linked data of window numbers indicated by the display control means; and
control means for controlling output of data read out from the memory planes in accordance with the mask bits in the mask data read out from the memory means.

11. An apparatus according to claim 10, wherein each of the control means has two input terminals, a first input terminal receiving data read out from the corresponding one of the memory planes, and a second input terminal receiving the mask bit from the memory means.

* * * * *